US005856784A

United States Patent [19]

Wiemeyer

[11] Patent Number: 5,856,784

[45] Date of Patent: Jan. 5, 1999

[54] LOW PROFILE IONIZATION CHAMBER

[75] Inventor: James F. Wiemeyer, Homer Township, Ill.

[73] Assignee: Pittway Corporation, Chicago, Ill.

[21] Appl. No.: 839,143

[22] Filed: Apr. 23, 1997

[51] Int. Cl.[6] ..... G08B 17/10

[52] U.S. Cl. ..... 340/629; 340/628; 250/381; 250/385.1; 250/393

[58] Field of Search ..... 340/629, 628; 250/381, 382, 385.1, 393

[56] References Cited

U.S. PATENT DOCUMENTS

| | | | |
|---|---|---|---|
| 3,908,957 | 9/1975 | Schutt | 340/629 |
| 4,194,191 | 3/1980 | Salem | 340/629 |
| 4,213,047 | 7/1980 | McCord | 340/629 |

*Primary Examiner*—Edward Lefkowitz

*Attorney, Agent, or Firm*—Rockey, Milnamow & Katz, Ltd.

[57] ABSTRACT

A very low profile ionization chamber provides increased operating current by using alpha particle emitting isotopes having low emission energies as an ionization source. The chamber includes a cylindrically shaped housing having height generally equal to a radius thereof. A conically shaped sensing electrode is carried within the housing. The housing is closed at one end by a main field electrode and at the other end by an insulating closure panel. A second field electrode is carried on the closure panel. The second field electrode also carries the ionization source. The conically shaped sensing electrode has an open central region which permits alpha particles to travel therethrough toward the first field electrode. The first field electrode could either exhibit a conical cross-section or could be planar. A chamber height on the order of 1.5 to 2 centimeters and a diameter in a range of 3–4 centimeters with a Gd148 source produces operating currents on the order of 10 pA.

46 Claims, 3 Drawing Sheets

LOW PROFILE IONIZATION CHAMBER

FIELD OF THE INVENTION

The invention pertains to sensing chambers for ionization-type smoke detectors. More particularly, the invention pertains to such chambers which incorporate low energy radioactive material useable in low profile chambers.

BACKGROUND OF THE INVENTION

Ionization-type smoke detectors are known and are widely recognized as useful in detecting airborne smoke indicative of a fire. Some of the known ionization-type sensors usually include a chamber having a portion open to the ambient atmosphere (active chamber) and a portion which is relatively sealed (reference chamber).

The chambers are often separated, at least in part, by a conductive sensing, electrode. Two exterior electrodes are spaced from the sensing element by the active and the reference chambers respectively.

A radioactive source(s) can be provided to inject alpha particles into the two chambers. As is known in the prior art, an electrical potential is usually applied between the two exterior electrodes. In this configuration and as biased, the two chambers behave as high impedance resistors with a small current flow between the two exterior electrodes. Known sources suitable for use in ion chambers include Americium241.

In response to changing ambient smoke conditions, which permeate into the active chamber, the voltage measurable at the sensing electrode will vary. This varying voltage is indicative of a smoke level and when compared to a pre-established alarm threshold can be used to detect the presence of an alarm condition.

As is known, ionization-type smoke detectors are conventionally placed on the ceilings of the regions being monitored. Known ionization-type sensors extend from the respective ceilings an amount which is determined at least in part, by the height of the ionization chamber.

Architectural preference has evolved in a direction which calls for low profile detectors. Such low profile detectors tend to be less easily noticed than detectors which extend from the ceiling a greater distance. Hence, shorter ionization chambers are preferable.

The miniaturization of ionization chambers inside smoke detectors generally causes a reduction of operating current, with the consequent reduction of stability and reliability of the detector. This result follows from inspection of the Bragg curve for alpha particles in air. Such a curve was published by authors Holloway & Livingston in 1938, in the paper, "Range & Specific Ionization of Alpha Particles." If the radiated alpha particles impinge upon an ionization chamber wall before creating their full allotment of ion pairs, then potential operating current in the ionization chamber is lost.

FIG. 1 illustrates a Bragg curve based on the above noted publication but extended by approximation beyond a range of 2.8 cm. The extended portion of FIG. 1, beyond 2.8 cm, is consistent with a corresponding curve published in "Study of Ionization Curves of Rays," R. Naido, Annales De Physiquie 11, 72 (1934).

Known types of radioactive materials used in prior art ionization-type sensors or chambers have radiated at relatively high energy levels. For example, Americium241, Am 241, a known radioactive isotope used in prior ionization chambers radiates at 5.5 MeV. This material as is also known emits some percentage of gamma radiation along with the preferred alpha particles. The alpha particles are the useful particles in connection with detection of smoke.

The known Bragg curve, FIG. 1 hereof, makes it clear that the most productive portion, in terms of generation of ion pairs, of an alpha particle emitted from an uncoated Am241 sample takes place on the order of 3.5 centimeters from the source. This in turn dictates that an ionization-type sensing chamber which locates the radiation material at the sensing electrode should extend at least on the order of 3.5 centimeters from the sensing electrode to the electrode associated with the active region. Similar comments apply to the height of the reference chamber.

If the source is coated, the distance may be less than 3.5 cm. While coating the source may reduce this distance, known 2 micron coatings tend to reduce radiation in a conically shaped volume adjacent to the surface of the source. This represents a significant loss of potential operating current and as a result is undesirable.

The required 3.5 centimeters of travel for optimal generation of ion pairs, as illustrated in FIG. 1, for each of the chambers leads to the conclusion that it may be very difficult to reduce the overall height of a smoke detector, which incorporates an uncoated Am241 source, as much as desired.

It would be desirable if ionization sensors could be configured to have an overall height less than the height noted above without a significant loss in operating current. Preferably, such chambers could still be used with conventional smoke detector control circuitry and without a need for different types of manufacturing skills than theretofore has been required in the manufacture of ion chambers.

Another trend in the fire protection industry has centered upon minimization of the total activity contained in smoke detectors. Reduction of radioactivity inside ionization chambers also tends to reduce the operating current, which already has been reduced to a low level. Therefore, a significant opportunity for improvement of ionization chambers rests in the responding to a challenge for a shorter ionization chamber (on the order of 2 cm), with less radioactivity (roughly 5000 Bq), and with reliable levels of operating current (roughly 10 pA).

SUMMARY OF THE INVENTION

A low profile ionization chamber includes first and second spaced apart electrodes with a sensing electrode disposed, at least in part, therebetween. A selected low initial emission energy isotope preferably is incorporated as a source of alpha particles.

Surprisingly, a short ionization chamber with Gd 148 (3.2 MeV) employed as an ionizing isotope can actually produce a higher operating current than chambers with higher energy isotopes such as Am241 (5.5 MeV). The reason for this rests in the previously unappreciated characteristics of alpha particles.

Higher specific ionization occurs near the end of the alpha trajectory, a lower energy state, than at higher energies. If an ionization chamber has radial dimensions less than 2 cm from the alpha source, then an alpha particle emitting isotope having an initial emission energy of 3.18 MeV actually utilizes the highest specific ionization region of the emission.

A comparison of initial energies to final energies, for an alpha track limited to 1.5 cm, indicates that the 3.18 MeV Gd148 emission creates more ion pairs than the 5.49 MeV AM241 emission during the 1.5 cm of travel. Numerical methods yield comparative values of ion generation of 2.75/1.4, or a factor of twice the operating current, with Gd148 compared with Am241.

One implementation of the present ionization chamber is in a two-sided source configuration with a "sealed" reference chamber and active chamber open to the supervised environment. The two chambers could be arranged side by side for the lowest profile. They could also be stacked which would result in a somewhat taller chamber. A low profile chamber would have a height on the order of 1.5–2 cm. A stacked chamber would be 3–4 cm high.

When smoke reaches the ionization smoke detector, the active chamber becomes affected by the smoke particulate, while the reference chamber remains unaffected. Typically an electronic circuit senses changes in the resulting center electrode voltage and uses various criteria to produce a warning or an alarm.

A more complex design, as described below, uses a Gd148 isotope on a single side of a source and incorporates reference and active chambers of drastically different dimensions. A center electrode is located at some electric potential between the main field electrodes. Other isotopes, such as AM241, can also be used with this structure.

A preferred embodiment of the "single sided source" design employs a conical center electrode shape to allow alpha radiation with minimal obstruction. In another aspect, the chamber may include a supplemental annular electrode.

The above chamber recovers ions generated in a significant volume of the ionization chamber, and uses them as active chamber current. The "reference chamber" term now describes the volume of the ionization chamber in the immediate vicinity of the source electrode.

The above chamber differs from past technology wherein the reference chamber was separated from the active chamber by an apertured center, sensing, electrode. For performance purposes, where separation of the "different" chamber volumes becomes necessary, an annular electrical insulator may be mounted on the center electrode cone.

The insulator serves to eliminate charge transfer between the center electrode and the air space immediately proximate to the insulator. The net result is a more definite separation of the reference and active chamber volumes.

If the ionizing isotope is surface deposited upon a planar object with a very thin protective coating, much less than 2 microns of gold, then alpha emission nearly parallel to the disc surface will occur. The large solid angle nearly parallel to the disc surface becomes filled with ions generated from the alpha radiation, making the conical center electrode design a very efficient one. The solid angle nearly perpendicular to the source plane then holds the least ion generation per unit of linear angle deviated from normal, and so constitutes the most easily sacrificed region within the hemisphere of alpha radiation.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
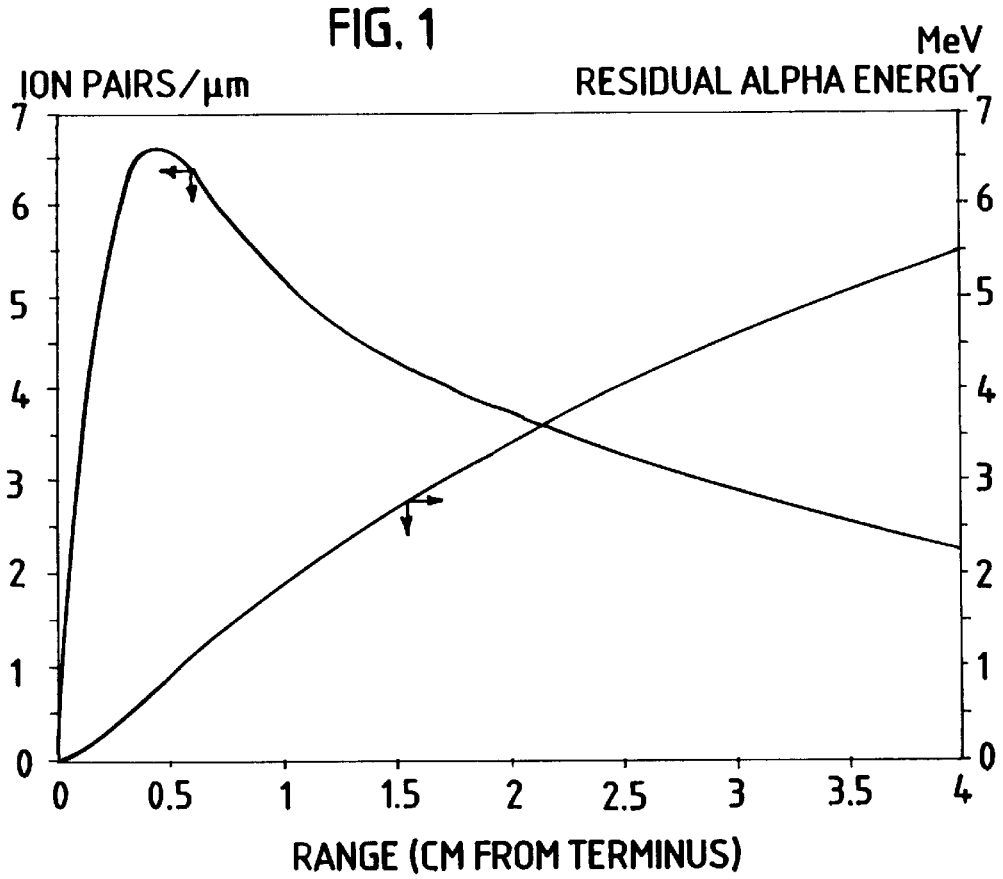
FIG. 1 is a graph illustrating ion pair production as a function of distance from source for Am241.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2:
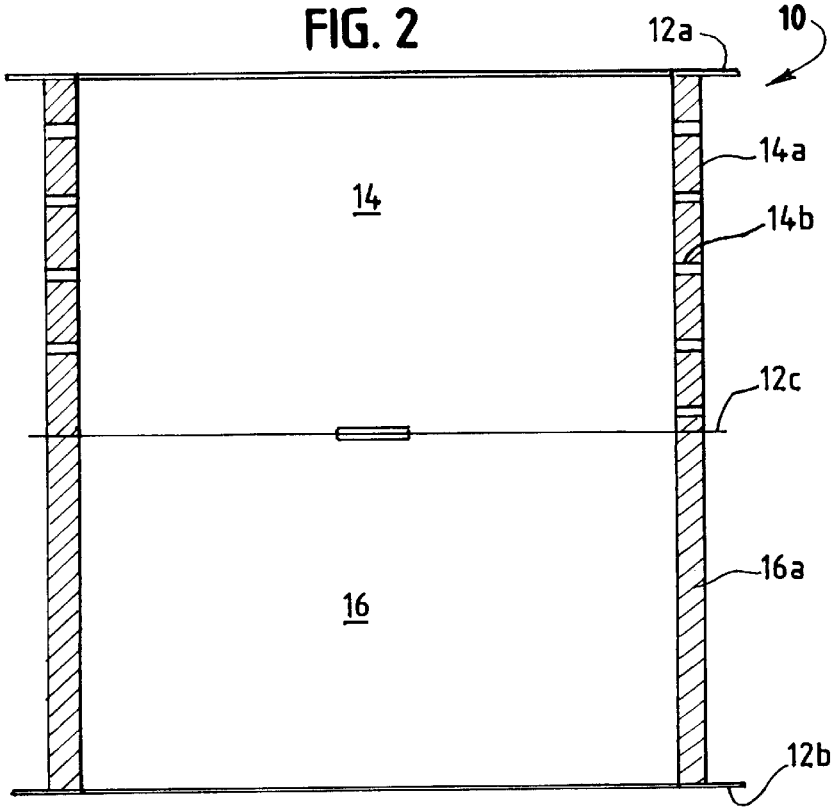
FIG. 2 is a side-sectional view of a low profile ionization chamber incorporating a low energy source of alpha particles.

FIG. 2 illustrates an ionization chamber 10 which can be configured so as to have a low profile on the order of 3 centimeters in height. The chamber 10 is formed with first and second spaced apart main field electrodes 12*a* and 12*b* with a sensing electrode 12*c* positioned therebetween.

An active chamber 14 is bounded by a perforated side-wall 14*a*, for example, formed of a non-conductive perforated plastic and enclosed by electrodes 12*a* and 12*c*. The active region 14 due to the openings or holes 14*b* in the side wall, is in fluid flow communication with the ambient atmosphere. As a result, products of combustion, such as smoke particulate matter, in the ambient atmosphere are able to freely enter the region 14 hence providing a measurable indication of smoke level in the ambient atmosphere.

A reference chamber or region 16, substantially sealed from the ambient atmosphere, is bounded by a side-wall 16*a* and the electrodes 12*b* and 12*c*.

While the chamber 10 is illustrated with a stacked configuration, it will be understood that alternate geometries could be used without departing from the spirit and scope of the present invention.

The electrode 12*c*, FIG. 2, carries a double sided source of a relatively low energy alpha particle emitting isotope such as Gd148. With reference to the graph of FIG. 3, a preferred height of each of the chambers 14 and 16 is on the order of 1.75 centimeters.

Figure 3:
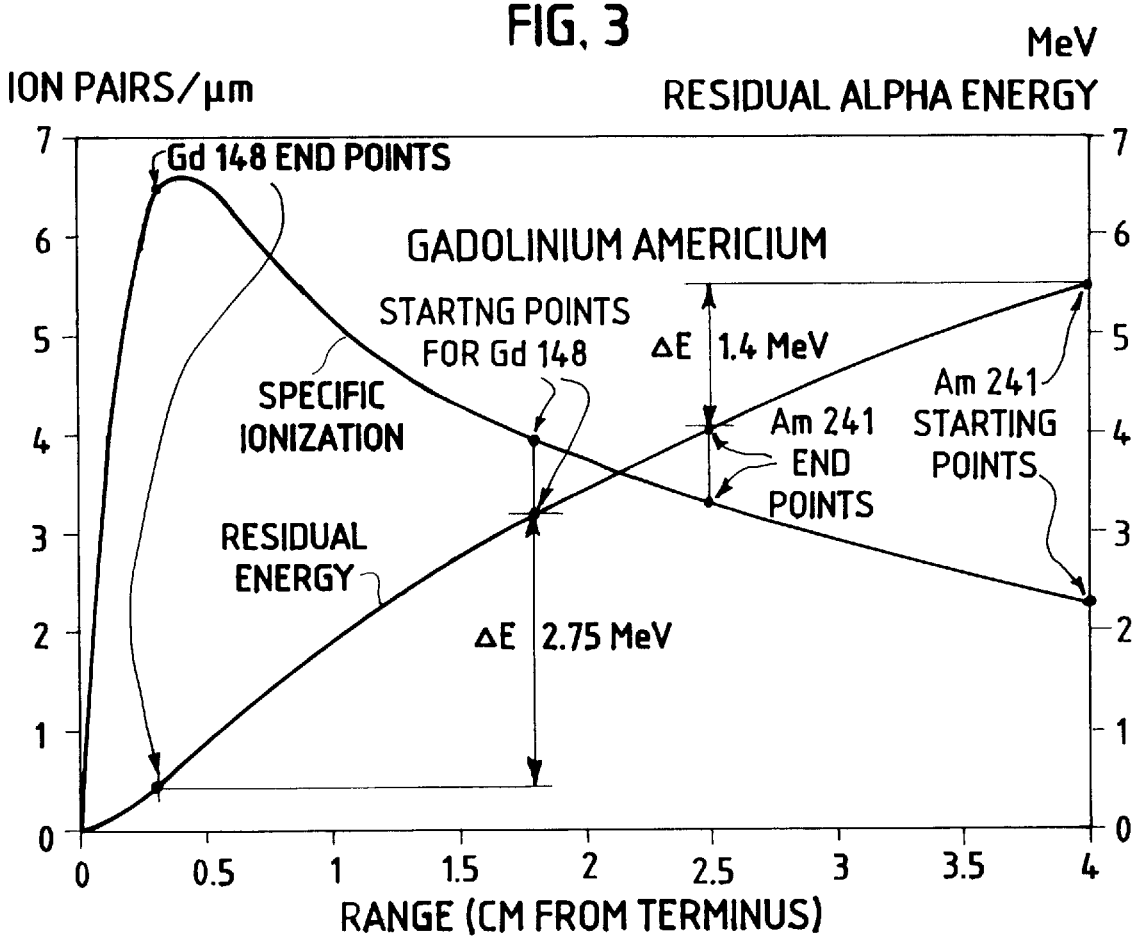
FIG. 3 is a graph illustrating ion pair production vs. distance from terminus for Gd148 vs. Am241.

As is illustrated in FIG. 3, low energy sources such as Gd148 (having an initial emission energy on the order of 3.2 MeV) exhibit maximum ion pair production at a distance on the order of 1.5 centimeters from the source. Hence, structuring the chamber 10 with the height of the regions 14 and 16 on the order of 1.5 to 2 centimeters each, will result in a low profile ionization chamber with significantly higher operating current than would be the case if a similarly configured ionization chamber incorporated Americium241 as the source.

Figure 4:
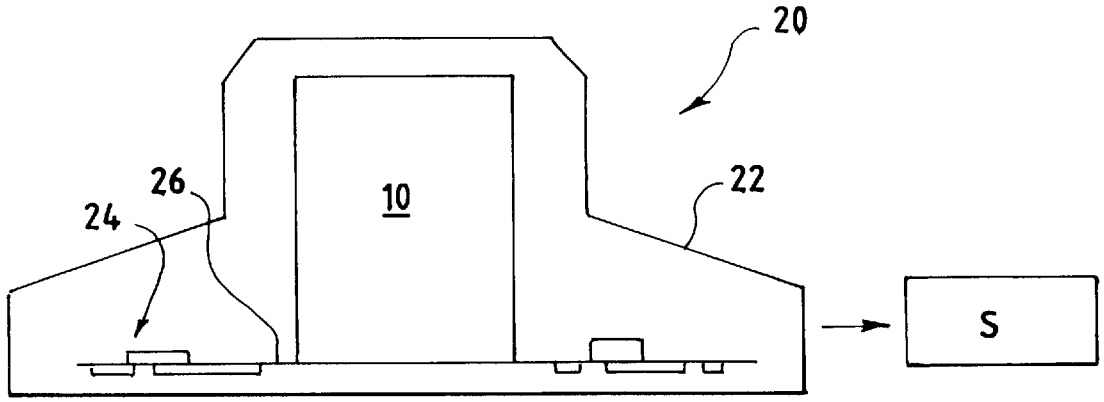
FIG. 4 is a side-sectional view of a smoke detector incorporating a low profile ionization chamber as in FIG. 2.

FIG. 4 illustrates a smoke detector 20 which incorporates a low profile ionization chamber, such as the chamber 10. The detector 20 includes a housing 22 which is open to ingress and egress of products of combustion, such as smoke particulate matter, in the adjacent ambient region such that the particulate matter and the smoke also enters the active chamber 14. A representative height of the detector 20 from the base thereof could be on the order of 3 centimeters or less.

Control electronics 24 could be carried on a supporting printed circuit board 26 in the housing 20. The unit 20 could be in communication with an alarm system S.

Figure 5:
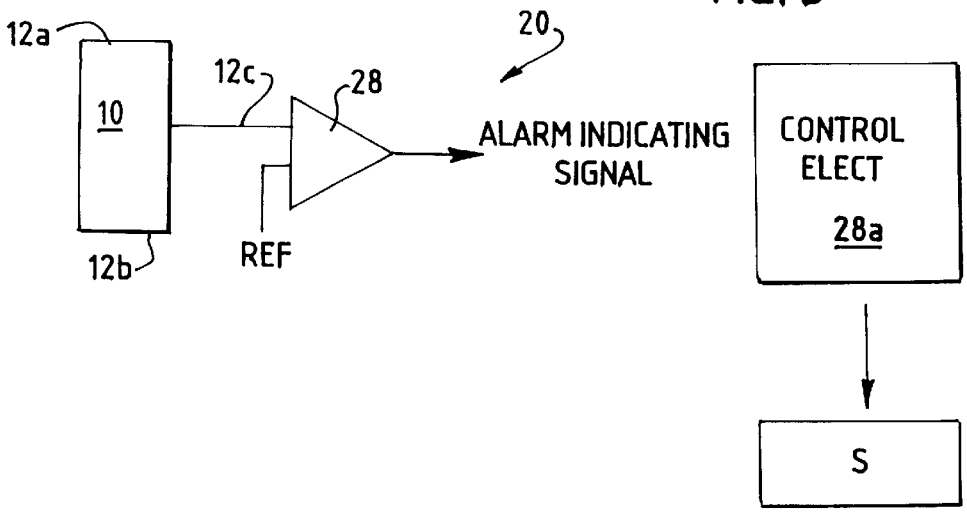
FIG. 5 is a schematic diagram illustrating additional aspects of the smoke detector of FIG. 4.

FIG. 5 is a schematic diagram illustrating further features of the detector 20. As illustrated in FIG. 5, the sensor 10 is coupled, via sensing electrode 12*c* to control electronics which could include, for example, a comparator 28. Comparator 28 compares the output voltage on sensing electrode 12*c* to a predetermined reference in the embodiment illustrated in FIG. 5. The output of the comparator 28 could in turn be coupled to additional control circuitry 28*a*.

It will be understood that the low profile ionization chamber 10 can be used with different electronic sensing circuits without departing from the spirit and scope of the present invention. It will also be understood that the chamber 10 could be configured with different geometries. For example, the chamber 10 could incorporate a side-by-side instead of a stacked configuration such that the active chamber, having a height on the order of 1.5 to 2 centimeters, would be located adjacent to the reference chamber 16 thereby producing a further reduction in overall height of the unit. The active chamber could be partly recessed in the reference chamber. It will also be understood that other variations in the structural aspects of the chamber 10 come within the spirit and scope of the present invention where such variations take advantage of the large quantities of ion pairs generatable by low energy emitting sources as described above.

It will also be understood that alternate types of low energy isotopes, as illustrated in Table 1, could also be used in ion chambers such as the chamber 10 without departing from the spirit and scope of the present invention.

TABLE 1

| MeV | Source |
|---|---|
| 1.83 | Nd-144 |
| 2.14 | Gd-152 |
| 2.23 | Sm-147 |
| 2.46 | Sm-146 |
| 2.50 | Hf-174 |
| 2.73 | Gd-150 |
| 3.18 | Gd-148 |
| 3.18 | Pt-190 |
| 3.95 | Th-232 |
| 4.011 | Th-232 |
| 4.15 | U-238 |
| 4.20 | U-238 |

Figure 6A:
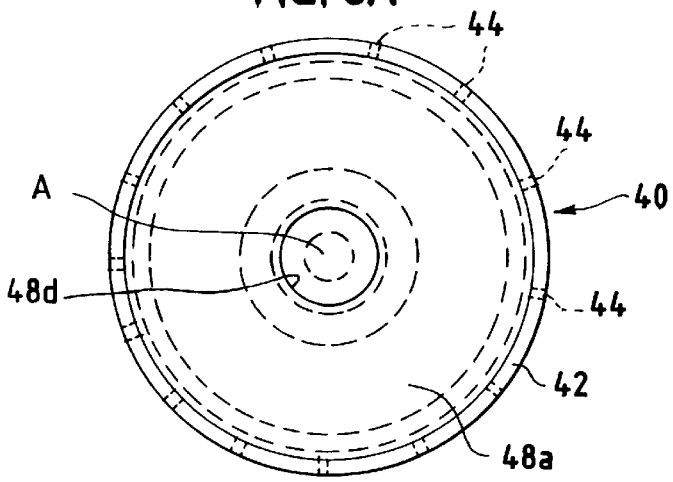
FIG. 6*a* is a top-plan view of an alternate embodiment of a low profile ionization chamber.
Figure 6B:
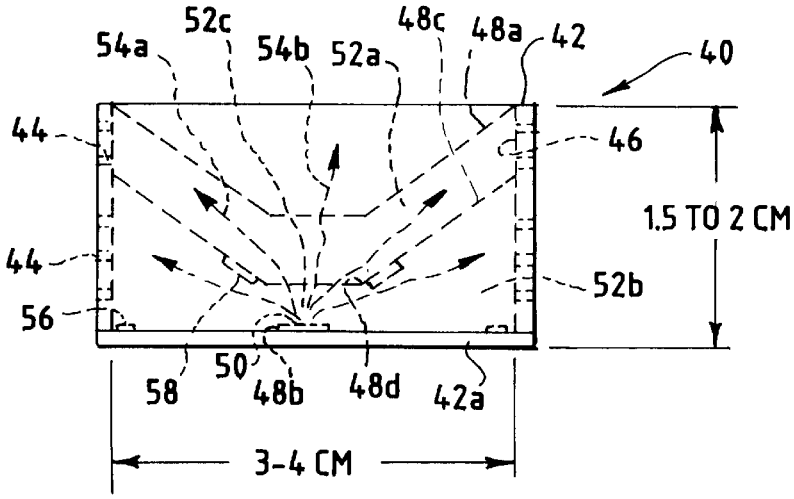
FIG. 6*b* is a side elevational view, partly in section, of the chamber of FIG. 6*a*.

FIGS. 6A and 6B illustrate another embodiment of low profile ionization chamber which incorporates a low energy isotope such as Gd148 as a source of alpha particles.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

A preferred embodiment of a low profile ionization chamber 40, as illustrated in FIGS. 6A and 6B includes a cylindrical exterior, non-conductive housing 42. The housing 42 includes a plurality of openings or perforations 44 to permit the ingress and egress of airborne products of combustion, smoke. The housing 42 defines an interior volume 46. The housing 42 is closed at one end by a planar non-conducting member 42*a*.

The housing 42 carries first and second spaced apart electrode elements 48*a* and 48*b*. The electrode element 48*a* has a conically shaped cross-section and extends into the volume 46. The electrode 48*b* is planar, and could be cylindrical and is carried on the closure panel 42*a*.

A third or sensing electrode 48*c* is carried by the housing 42 in the interior volume 46 generally between the electrodes 48*a* and 48*b*. The sensing electrode 48*c* has a generally conically shaped cross-section. Unlike the electrode 48*a* which has no openings therein, the sensing electrode 48*c* has an open centrally located aperture 48*d*.

An ionization source 50 is deposited on the centrally located electrode 48*b*. A preferred source is Gd148.

The chamber 40 would be connected to exterior electrical circuitry in a known fashion to apply an electrical potential across electrodes 48*a* and 48*b*. An electrical potential can be sensed off of the sensing electrode 48*c* which is indicative of the level of the smoke in the adjacent ambient atmosphere and in the interior region 46.

While the chamber 40 can be used with a variety of ionization sources, in the preferred embodiment of FIG. 6A and 6B, the source 50 would preferably be selected from a class which contains isotopes which emit alpha particles at relatively low energy levels such as Gd148. With such a source, the height of the chamber 42 could be reduced to a range of 1.5 to 2 centimeters. Resultant operating currents would be in a range of 5 pA to 22 pA with 5 KBq.of radioactive material.

The low profile of the chamber 40 results not only from the choice of isotope but also from the geometry thereof. Unlike known ionization chambers, the chamber 40 does not exhibit separate active and reference chambers. Instead, the geometry of the chamber 40 creates an active chamber region or volume, indicated generally at 52*a* and 52*b*. The active chamber regions 52*a* and 52*b*, for a cylindrical housing 42 would have a substantially annular or donut shape.

A reference chamber volume 52*c* is located between the electrode element 48*b* and the annular open region 48*d* of the sensing electrode 48*c*. Hence, the alpha particles emitted from the source 50, indicated generally at 54*a*, 54*b* must pass through the reference chamber volume 52*c* before entering the active chamber region or volume 52*a* and 52*b*.

Improved performance can be achieved by incorporating an additional annular electrode element 56. The element 56 is carried on the closure panel 42*a* and surrounds the electrode element 48*b* and the ionization source 50. The electrode element 56 would be electrically connected to the electrode element 48*a*. Finally, to further enhance the definition between the active and the reference regions, an annular insulating member 58 can be carried on the centrally located sensing electrode 48*c*.

It will also be understood that the chamber 40 is symmetrical about an axis A which extends perpendicular to the closure panel 42*a* and through the source 50. In addition to a low profile height on the order or 1.5 to 2 centimeters, the chamber 40 preferably has a diameter on the order of 3 to 4 centimeters again consistent with the radiating characteristics of low energy alpha emitting sources such as Gd148.

For purposes of isolating and protecting the source 50, it could be coated with an ultra thin layer of gold on the order of 0.2 microns.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An ionization-type smoke detector comprising:

a low profile-type chamber having an internal particle travel distance of less than 2.5 cm;

an ion source carried within the chamber wherein the source is selected from a class having an initial emission energy level less than 4 MeV and wherein the source emits particles in the chamber on paths corresponding in length to the internal travel distance.

2. A detector as in claim 1 wherein the source is selected from a class having an initial emission energy level less than 3.5 MeV.

3. A detector as in claim 1 wherein the internal travel distance corresponds to a mean travel distance of alpha particles emitted from the source in air and wherein the interaction of the mean travel distance and the source produces more than 4 ion pairs per micrometer.

4. A detector as in claim 3 wherein the interaction of particles emitted from the source, in combination with the mean travel distance in the housing and the initial emitted energy levels result in production of more than 5 ion pairs per micrometer at distances of 1–2 cm from the source.

5. A detector as in claim 4 wherein the source is selected from a class which includes Gd148, Gd150 and Pt190.

6. A detector as in claim 2 wherein the source includes an alpha particle emitting material.

7. A detector as in claim 3 wherein the chamber carries at least first and second spaced apart electrodes and wherein one of the electrodes corresponds to an output electrode and wherein an electric potential can be applied to the other.

8. A detector as in claim 7 wherein the chamber carries a third electrode with the output electrode positioned, at least in part, between the other two electrodes.

9. A detector as in claim 8 wherein the output electrode is at least in part, non-planar.

10. A detector as in claim 8 wherein the output electrode includes a region having generally conical cross-section.

11. A detector as in claim 10 wherein one of the other two electrodes includes a region having a generally conical cross-section.

12. A detector as in claim 11 wherein the other of the two electrodes carries the ion source.

13. A detector as in claim 12 wherein the ion source is carried on a planar conducting member.

14. A detector as in claim 12 wherein at least one of the conical cross-sections extends toward the ion source.

15. A detector as in claim 14 wherein one of the conical cross-sections is nested, at least in part, in the other.

16. A detector as in claim 15 which includes an annular electrode which encircles the source.

17. A detector as in claim 15 wherein one of the electrodes carries an annular insulator on a respective one of the conical cross-sections.

18. A detector as in claim 15 which includes Gd148 in the source.

19. A detector as in claim 15 wherein the source generates an operating current in excess of 8 pA.

20. An ionization-type smoke sensor comprising:

a housing having an over-all exterior height of less than 2 cm and an internal volume;

a source of alpha particles carried within the housing wherein the particles exhibit a mean travel distance therein less than 2 cm and generate in excess of 5 ion pairs per micrometer along a portion thereof.

21. A sensor as in claim 20 wherein the source is selected from a class which includes Gd148, Gd150 and Pt190.

22. A sensor as in claim 20 wherein the source emits alpha particles into the internal volume, wherein at least some of the particles pass through a reference volume and into an active volume.

23. A sensor as in claim 22 wherein the housing carries first and second spaced apart electrodes and a sensing electrode which extends, at least in part, therebetween.

24. A sensor as in claim 23 wherein the source is carried on the first electrode.

25. A sensor as in claim 24 wherein the second and sensing electrodes are non-planar and generally extend parallel to one another.

26. A sensor as in claim 25 wherein the sensing electrode includes a central open region.

27. A sensor as in claim 25 which includes an annular electrode, coupled to the second electrode, which surrounds the first electrode.

28. A sensor as in claim 25 wherein the source includes Gd148.

29. A sensor as in claim 27 which includes an annular insulator carried by the sensing electrode and oriented in a plane parallel to a plane in which the annular electrode extends.

30. An ionization chamber comprising:

a housing having first and second ends and wherein the housing defines an internal volume;

a sensing electrode carried by the housing wherein the electrode has a conical cross-section that extends into the housing a source of alpha particles carried within the housing wherein the source exhibits an energy level of less than 4 MeV and wherein the particles exhibit a mean travel distance therein less than 2 cm and generate in excess of 5 ion pairs per micrometer along a portion thereof.

31. A chamber as in claim 30 wherein the housing carries an ionization source and wherein the source is selected from a class which includes Gd148 and Am241.

32. A chamber as in claim 30 which includes:

a source and a first electrode carried at one end of the housing wherein the source is carried on the electrode.

33. A chamber as in claim 32 which includes:

a second electrode carried at the other end of the housing wherein the sensing electrode extends, at least in part, between the electrodes.

34. A chamber as in claim 33 wherein the sensing electrode terminates in an open region adjacent to the source.

35. A chamber as in claim 34 wherein the interaction between the sensing electrode, the source and the first electrode defines a reference chamber volume between the source and the open region of the sensing electrode.

36. A chamber as in claim 34 wherein an active chamber region is defined between the sensing electrode and the second electrode.

37. A chamber as in claim 34 wherein the housing has a height of no more than 2 centimeters.

38. A chamber as in claim 37 which exhibits an operating current in a range of 5 pA to 22 pA.

39. A chamber as in claim 30 wherein the housing has height and width parameters and wherein the width parameter has a value on the order of twice the height parameter.

40. A chamber as in claim 32 which includes an annular insulator carried on a selected electrode.

41. A chamber as in claim 32 which includes an annular additional electrode.

42. An ionization-type smoke detector comprising:

a housing having an over-all exterior height of less than 2 cm and an internal volume;

a source of alpha particles carried within the housing wherein the source exhibits an energy level of less than 4 MeV and wherein the particles exhibit a mean travel distance therein less than 2 cm and generate in excess of 5 ion pairs per micrometer along a portion thereof.

43. A detector as in claim 42 which includes a conical sensing electrode.

44. A detector as in claim 43 wherein the source comprises a material from a class which includes Gd148, Gd150 and Pt190.

45. A detector as in claim 42 wherein the mean travel distance falls in a range of 1.5 to 2 cm.

46. An ionization-type smoke detector comprising:

a low profile-type chamber having an internal particle travel distance of less than 2.5 cm;

an ion source carried within the chamber wherein the source has an activity level of less than 5 KBq and is selected from a class having an initial emission energy level less than 4 MeV and wherein the source emits particles in the chamber on paths corresponding in length to the internal travel distance.

* * * * *